US005566896A

United States Patent [19]

Stehr et al.

[11] Patent Number: 5,566,896

[45] Date of Patent: Oct. 22, 1996

[54] AGITATOR MILL

[75] Inventors: Norbert Stehr, Grünstadt; Philipp Schmitt, Lampertheim, both of Germany

[73] Assignee: EVV-Vermögensverwaltungs-GmbH, Wiesloch, Germany

[21] Appl. No.: 524,778

[22] Filed: Sep. 7, 1995

[30] Foreign Application Priority Data

Sep. 9, 1994 [DE] Germany ..... 44 32 203.8

[51] Int. Cl.[6] ..... B02C 17/16

[52] U.S. Cl. ..... 241/171; 241/174

[58] Field of Search ..... 241/171, 172, 241/174

[56] References Cited

U.S. PATENT DOCUMENTS

| | | | |
|---|---|---|---|
| 3,844,490 | 10/1974 | Schold et al. | 241/74 |
| 4,042,179 | 8/1977 | Myers et al. | 241/46.11 |
| 4,206,879 | 6/1980 | Geiger | 241/46.11 |
| 4,496,106 | 1/1985 | Gross | 241/46.17 |
| 4,620,673 | 11/1986 | Canepa et al. | 241/69 |
| 4,834,301 | 5/1989 | Inkyo et al. | 241/33 |
| 5,062,577 | 11/1991 | Schmitt et al. | 241/171 |
| 5,333,804 | 8/1994 | Liebert | 241/69 |

FOREIGN PATENT DOCUMENTS

0146852B1 7/1985 European Pat. Off. .

*Primary Examiner*—John M. Husar
*Attorney, Agent, or Firm*—Browdy and Neimark

[57] ABSTRACT

An agitator mill comprises a grinding receptacle and an agitator unit disposed in the latter and having an agitator shaft. The agitator shaft is hollow, this grinding-stock/auxiliary-grinding-body return chamber being connected with the grinding chamber at one end of the agitator shaft. At the other end of the agitator shaft, the return chamber opens into a cage-type section of the agitator shaft, an auxiliary-grinding-body retaining device likewise projecting into this section.

11 Claims, 3 Drawing Sheets

AGITATOR MILL

BACKGROUND OF THE INVENTION

1. Field of the Invention

The invention relates to an agitator mill.

2. Background Art

U.S. Pat. No. 4,496,106 discloses an agitator mill that comprises an auxiliary-grinding-body return line discharging from the grinding receptacle upstream of an auxiliary-grinding-body separator device and opening into the grinding chamber at the other end of the grinding receptacle. Directly before this junction, a grinding-stock supply line opens into the auxiliary-grinding-body return line. As a result of the centrifugal effect produced by the agitator unit, the auxiliary grinding bodies and grinding stock not sufficiently milled the to be catapulted off through the auxiliary-grinding-body outlet and returned through the grinding-body return line. By the auxiliary-grinding-body return line opening into the grinding-stock supply line, a suction is to be generated, still supporting the centrifugal effect. Further, excellent preliminary mixing of the grinding stock and the auxiliary grinding bodies is to result in the grinding-stock supply line. Experience has shown that any reliable circulation of the auxiliary grinding bodies cannot be ensured by this design of the known agitator mill. The auxiliary grinding bodies get stuck in the auxiliary-grinding-body return line, where they stay. Although, owing to their basic concept, agitator mills of this type have considerable advantages where a high throughput of grinding stock is required that is marked by a considerable transport of auxiliary grinding bodies in the grinding chamber to the separator device, this type of agitator mills has not been successful in practice, because the circulation of the auxiliary grinding bodies does not work satisfactorily.

An agitator mill is known from U.S. Pat. No. 5,062,577, which has a cylindrical grinding chamber with a likewise cylindrical internal stator. A cup-shaped rotor penetrates the annular space between the wall and the internal stator; the rotor defines an annular outer grinding chamber and an annular inner grinding chamber, which are interconnected by a deflection chamber in the vicinity of the free end of the rotor. Overflow channels are provided in the vicinity of the bottom of the rotor. This is also the portion to which a grinding stock inlet portion is assigned. Further, the portion of these overflow channels is followed, in the direction of flow, by an auxiliary-grinding-body retaining device. Grinding stock is supplied through the grinding-stock inlet portion, flowing together with the auxiliary grinding bodies through the outer grinding chamber, the deflection chamber and the inner grinding chamber, while being milled and dispersed through the rotation of the rotor in cooperation with the auxiliary grinding bodies. Before reaching the auxiliary-grinding-body retaining device, the auxiliary grinding bodies are catapulted off via the overflow channels back into the grinding-stock inlet portion. The grinding stock is discharged via the retaining device. As a result of this embodiment, a grinding-stock fineness is achieved that is extraordinarily uniform, the retaining device simultaneously being largely free from wear, which helps preclude any breakdown.

An agitator mill is known from EP 0 146 852 B1, comprising a grinding receptacle with a cylindrical inner wall and a cylindrical agitator unit, an annular cylindrical grinding chamber being formed between the agitator unit and the inner wall of the grinding receptacle. At its free end, the agitator unit has a cavity, into which projects a separator device. In this area, the agitator unit is provided with recesses all around the separator device, the recesses allowing the auxiliary grinding bodies, which reach the cavity from the front of the free end of the shaft, to be discharged radially into the adjacent grinding chamber. There is the risk of auxiliary grinding bodies compacting in the vicinity of the free shaft end, i.e. around the cavity.

An agitator mill with a vertical agitator unit is known from S.U. patent 737 004. The grinding stock is supplied in the vicinity of the bottom of the grinding receptacle and is discharged under the lid of the grinding receptacle through a filter cylinder. The agitator shaft is hollow and open towards its free end adjacent to the bottom. Several openings are provided along the height of the agitator shaft. This embodiment helps ensure that auxiliary grinding bodies depositing on the bottom move upward through the agitator shaft and are catapulted off into the grinding chamber in a manner distributed along the height of the grinding chamber.

SUMMARY OF THE INVENTION

It is the object of the invention to embody an agitator mill in which any compressing of the auxiliary grinding bodies is avoided.

This object is attained in an agitator mill comprising a grinding receptacle, of which a cylindrical wall and a first end wall and a second end wall define a grinding chamber, an agitator unit disposed in the grinding receptacle and having an agitator shaft, which is cantilevered outside the grinding chamber and finished by a free end inside the grinding chamber, and agitator elements attached to the agitator shaft, a drive motor for the high-speed actuation of the agitator unit, a cage-type section, which is attached to the free end of the agitator shaft in vicinity to the second end wall and defines an inner chamber, an annular cylindrical grinding-stock inlet chamber between the cage-type section defining an inner chamber, and the wall of the grinding receptacle, a grinding-stock inlet disposed at least in vicinity to the second end wall of the grinding receptacle and opening into the annular cylindrical grinding-stock inlet chamber, an auxiliary-grinding-body retaining device disposed in the inner chamber of the cage-type section, a grinding-stock outlet contiguous to the auxiliary-grinding-body retaining device and passing through the second end wall, a grinding-stock/auxiliary-grinding-body return chamber, which is formed in the agitator shaft, and which, in vicinity to the first end wall of the grinding receptacle, is connected with the grinding chamber via at least one inlet passage in the agitator shaft, and which opens via a junction into the inner chamber of the cage-type section, passages formed in the cage-type section and connecting the inner chamber with the grinding-stock inlet chamber. The grinding- stock inlet and the grinding-stock outlet are at the same end of the grinding chamber. The auxiliary grinding bodies catapulted off the cage-type section enter the grinding-stock inlet chamber, from where they are moved, along with the stream of grinding stock, into the actual grinding chamber where the grinding process takes place. Like the retaining device according to U.S. Pat. No. 5,062,577, the auxiliary-grinding-body retaining device is not acted upon by auxiliary grinding bodies to any relevant extent, i.e. it is not subject to any substantial wear. On the other hand, as uniform as possible a distribution of auxiliary grinding bodies is ensured in the grinding chamber, which contributes to an optimization of the grinding result and to a troublefree operation accompanied by high throughputs, because no compressing of auxiliary grinding bodies occurs in the entire system. The measures according to the invention can be used in agitator mills with a vertical agitator unit, a horizontal agitator unit or with an agitator unit biased at an angle to the horizontal or the vertical.

Further features, details and advantages of the invention will become apparent from the ensuing description of an exemplary embodiment, taken in conjunction with the drawing.

DESCRIPTION OF THE PREFERRED EMBODIMENT

Figure 1:
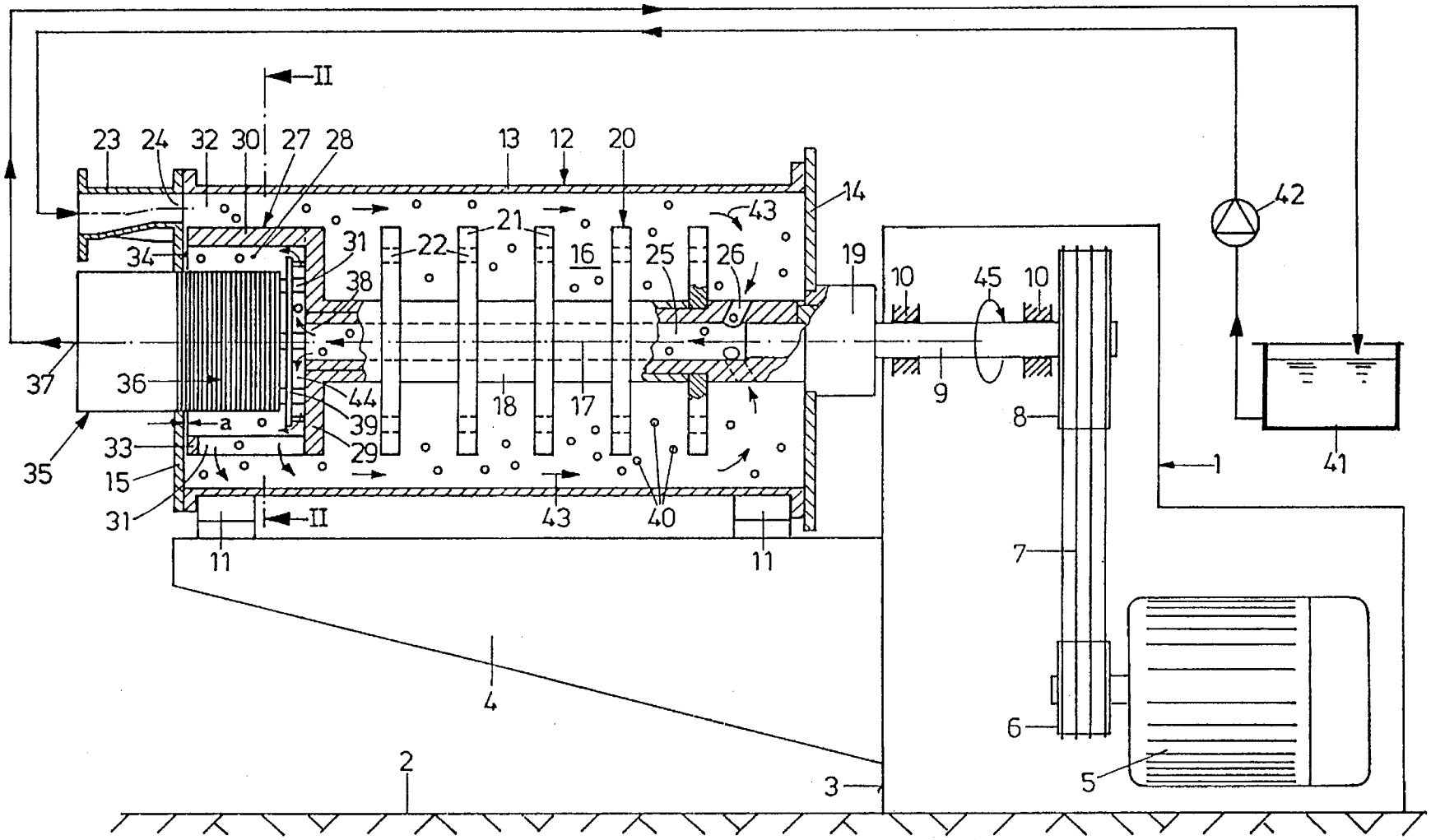
FIG. 1 is a diagrammatic view of a vertical longitudinal section of an agitator mill.

The example of embodiment shown in the drawing is a horizontal agitator mill. In usual manner, it comprises a stand 1 supported on the ground 2. A support arm 4 is attached to the face 3 of the stand 1.

The stand 1 houses a drive motor 5 speed-variable, if required, which is provided with a V-belt pulley 6, by means of which a drive shaft 9 can be driven for rotation by way of a V-belt 7 and another V-belt pulley 8. The drive shaft 9 is rotatably run in several bearings 10 on the stand 1.

A substantially cylindrical grinding receptacle 12 is supported on the support arm 4 in corresponding retainers 11. The grinding receptacle 12 has a cylindrical wall 13, its end facing the stand 1 being closed by a lid 14 and the opposite end by a bottom 15 which encloses a grinding chamber 16.

Figure 2:
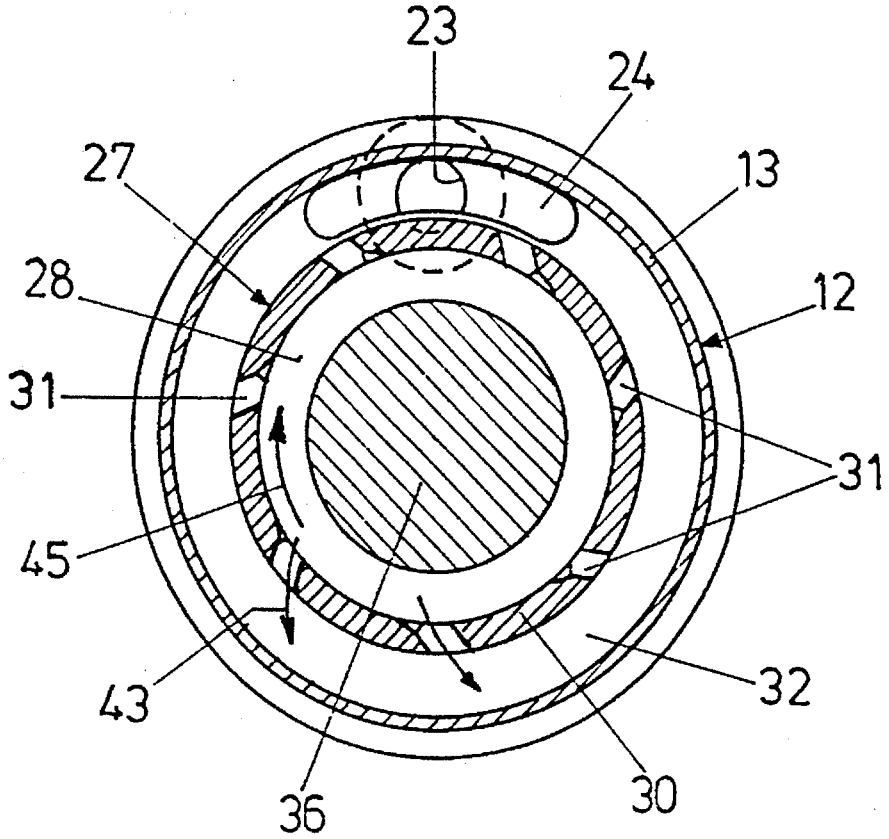
FIG. 2 is a cross-section of the agitator mill on the section line II—II of FIG. 1.

A agitator shaft 18 passing through the lid 14 is disposed in the grinding chamber 16 concentrically of the common central longitudinal axis 17 of the grinding receptacle 12 and the drive shaft 9. The grinding chamber 16 is sealed by seals 19 between the lid 14 and the shaft 18. The shaft 18 is cantilevered, i.e. it is not run in bearings in the vicinity of the bottom. Over its length within the grinding chamber 16, it is provided with agitator elements 20, which are agitator disks 21 in the present case. The agitator disks 21 may in usual manner be provided with openings 22. A grinding-stock supply connector 23 is provided in the bottom 15 in close vicinity to the wall 13, opening into the grinding chamber 16. As seen in FIG. 2, the grinding-stock inlet 24, opening into the grinding chamber 16, of the supply connector 23 has the shape of a section of an annulus.

The agitator shaft 18 is hollow, i.e. it comprises a grinding-stock/auxiliary-grinding-body return passage 25 which extends over its length and serves as a grinding-stock/auxiliary-grinding-body return chamber and which, in close vicinity to the lid 14 of the grinding receptacle 12 is connected with the grinding chamber by way of inlet passages 26. These inlet passages 26 are inclined from the grinding chamber 16 to the grinding-stock/auxiliary-grinding-body return passage 25 in a direction towards the bottom 15, as illustrated by FIG. 1. A cage-type section 27 defining an inner chamber 28 is attached to the free end of the agitator shaft 18 and thus in the vicinity of the bottom 15. The cage-type section 27 is formed by an annular disk 29 mounted on the agitator shaft 18 and by a cylinder 30 extending from the annular disk 29 as far as to the bottom 15 and housing passages 31 that are parallel to the central longitudinal axis 17. Toward the wall 13, the cage-type section 27 provided with passages 31 defines an annular grinding-stock inlet chamber, into which opens the grinding-stock inlet 24 that extends over the entire radial width of the inlet chamber 32. The cylinder 30 extends as far as into the close proximity of the bottom 15 so that only a gap 34 of minor width a is left between the bottom 15 and the cylinder 30, which is finished by a ring 33 on the open end of the cage 27, the width a of the gap 34 ranging from less than 1 mm to few millimeters, for instance 3 mm. The inner chamber 28 of the cage 27 houses an auxiliary-grinding-body retaining device 35 in the form of a cylindrical slotted screen 36. This is followed by a grinding-stock outlet 37 that passes through the bottom 15.

In front of the junction 38, where the cavity 25 of the agitator shaft 18 passes into the inner chamber 28 of the cage 27, the annular disk is provided with a deflector disk 39 that extends as far as into the proximity of the cylinder 30. To a substantial extent, the grinding chamber 16 is filled with auxiliary grinding bodies 40 of a diameter ranging from 0.2 to 3.0 mm, usually to 2.0 mm.

By means of a pump 42, the grinding stock is supplied from a reservoir 41 via the grinding-stock supply connector 23 into the inlet chamber 32. Together with the auxiliary grinding bodies 40, it flows through the grinding chamber 16 in the direction towards the lid 14 in accordance with the arrows 43 of flow direction, the grinding stock and the auxiliary grinding bodies 40 being acted upon by the high-speed agitator elements 20, which results in a grinding and dispersing process taking place in known manner. The stream of grinding stock and auxiliary grinding bodies is deflected before the lid 14 and piloted through the inlet passages 26 into the grinding-stock/auxiliary-grinding-body return passage 25 of the agitator shaft 18, this mix flowing through the return channel 25 until it enters the inner chamber 28 of the cage 27. The deflector disk 39 provides for the flow of grinding stock and auxiliary grinding bodies to be deflected radially outwards, the grinding stock and the auxiliary grinding bodies 40 being accelerated in the gap 44 between the annular disk 29 and the deflector disk 39 in the direction of rotation 45 of the agitator shaft 18. When the auxiliary grinding bodies 40, coming from the gap 44, enter the inner chamber 28 of the cage 27 in the vicinity of the cylinder 30, they are catapulted off outwards radially to the axis 17 via the passages 31 and into the grinding-stock inlet chamber 32. The grinding stock is discharged from the mill through the slotted screen 36 and i then via the grinding-stock outlet 37. The auxiliary grinding bodies 40 catapulted into the grinding-stock inlet chamber 32 are taken along by the grinding stock supplied via the supply connector 23 and are transported again into the grinding chamber 16.

As a result of the measures specified, there is an internal circulation of the auxiliary grinding bodies 40 taking place in accordance with the arrows 43 of flow direction over the entire length of the grinding chamber 16. Any short-cut flow between the grinding-stock supply connector 23 and and the inner chamber 28 of the cage 27 is precluded.

Figure 3:
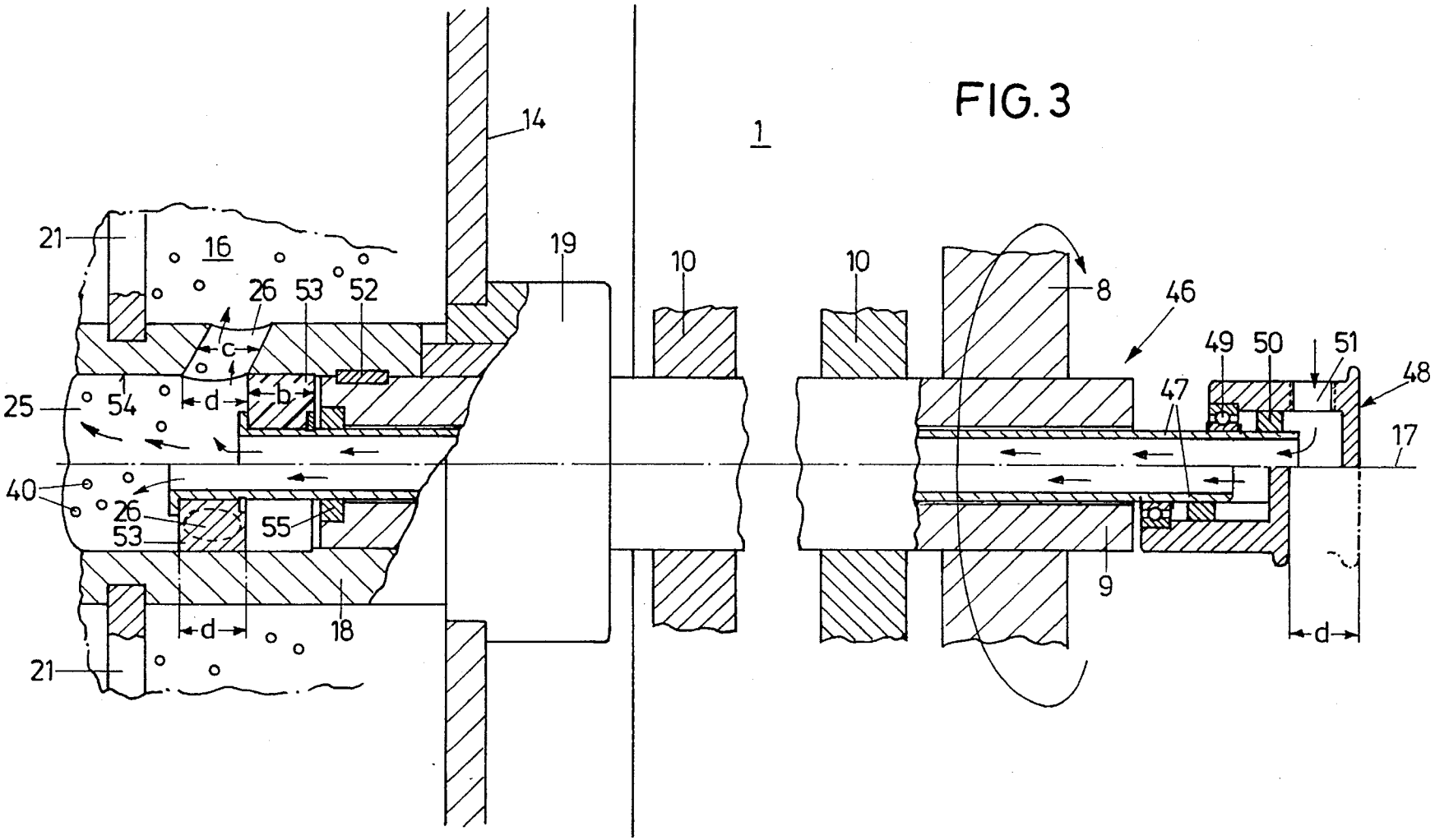
FIG. 3 is an illustration of a device for cleaning the hollow shaft of the agitator mill.

FIG. 3 illustrates a device 46 for cleaning the grinding-stock/auxiliary-grinding-body return passage 25 formed in the agitator shaft 18, from grinding stock and auxiliary grinding bodies 40. Like the agitator shaft 18, the drive shaft 9 is a hollow shaft non-rotatably joined to the agitator shaft 18. A sliding sleeve 47 is guided in the drive shaft 9 for displacement in the direction of the central longitudinal axis 17. The sliding sleeve 47 is non-rotatable in relation to the drive shaft 9 and thus to the agitator shaft 18.

At the end of the sliding sleeve 47 located outside of the agitator shaft 18 and the drive shaft 9, a pipe coupling 48 is fixed to the sliding sleeve 47 to be rotatable by means of a bearing 49 and sealed by a seal 50. This pipe coupling 48 can be arrested stationarily when the drive shaft 9 and the agitator shaft 18 are driven in rotation.

The pipe coupling is provided with a hose connection 51 into which to screw a hose, through which compressed gas or a pressurized rinsing fluid can be supplied.

The sliding sleeve 47 extends beyond the joint 52 between the drive shaft 9 and the agitator shaft 18, an annular closing piston 53 being attached to this end of the sliding sleeve 47. The closing piston 53 bears sealingly against the inside wall 54 of the return passage 25. To this end, it consists of an appropriate material, such as PTFE or the like. The length b of the closing piston 53 in the direction of the axis 17 at least slightly exceeds the diameter c of the inlet passages 26 or, respectively, the extension of the latter in the direction of the axis 17, so that the inlet passages 26 can be closed by the closing piston 53, as seen in FIG. 3 at the bottom. The sliding sleeve 47 is displaceable by a travel d between its two end positions shown in FIG. 3 at the top and at the bottom, respectively, the travel d being dimensioned such that in one end position—shown at the top of FIG. 3—the closing piston 53 does not cover the inlet passages 26. In this end position, the closing piston 53 is located between the adjacent end of the drive shaft 9 and the inlet passages 26. In the other end position—shown at the bottom of FIG. 3—in which the sliding sleeve 47 is pushed into the return channel 25 of the agitator shaft 18, the annular closing piston 53 covers the inlet passages 26.

When, in the position shown at the bottom in FIG. 3, in which the inlet passages 26 are closed by the closing piston 53, compressed gas or a pressurized rinsing fluid is supplied as a cleaning agent through the pipe coupling 48 and the sliding sleeve 47 into the return channel 25, then this cleaning agent flows exclusively through the return passage 25, clearing the latter from auxiliary grinding bodies 40 and grinding stock. Of course, the inner chamber 28 of the cage-type section 27 and the auxiliary-grinding-body retaining device 35 are cleaned, too. Moreover, partial cleaning of the grinding-stock inlet chamber 32 can take place, if required. A seal 55 between the drive shaft 9 and the sliding sleeve 47 prevents compressed gas and pressurized rinsing fluid from escaping outwardly between the drive shaft 9 and the sliding sleeve 47. If, however, the sliding sleeve 47 is extracted as far as possible out of the drive shaft 9, then the closing piston 53 is in the position shown at the top of FIG. 3. When, in this case, compressed gas or pressurized rinsing fluid is supplied, then part of this will be discharged via the return passage 25, performing the cleaning jobs described above. Another part of this cleaning agent flows through the inlet passages 26, cleans same and then continues to flow through the entire grinding chamber 16, the latter and the auxiliary grind bodies 40 located there being cleaned. The agitator shaft 18 is driven in both cleaning processes described.

What is claimed is:

1. An agitator mill, comprising a grinding receptacle (12), of which a cylindrical wall (13) and a first end wall (14) and a second end wall (15) define a grinding chamber (16);

an agitator unit disposed in the grinding receptacle (12) and having an agitator shaft (18), which is cantilevered outside the grinding chamber (16) and finished by a free end inside the grinding chamber (16), and agitator elements (20) attached to the agitator shaft (18);

a drive motor (5) for a high-speed actuation of the agitator unit;

a cage-type section (27), which is attached to the free end of the agitator shaft (18) in vicinity to the second end wall (15) and defines an inner chamber (28);

an annular cylindrical grinding-stock inlet chamber (32) between the cage-type section (27) defining an inner chamber (28), and the wall (13) of the grinding receptacle (12);

a grinding-stock inlet (24) disposed at least in vicinity to the second end wall (15) of the grinding receptacle (12) and opening into the annular cylindrical grinding-stock inlet chamber (32);

an auxiliary-grinding-body retaining device (35) disposed in the inner chamber (28) of the cage-type section (27);

a grinding-stock outlet (37) contiguous to the auxiliary-grinding-body retaining device (35) and passing through the second end wall (15);

a grinding-stock/auxiliary-grinding-body return chamber (25), which is formed in the agitator shaft (18), and which, in vicinity to the first end wall (14) of the grinding receptacle (12), is connected with the grinding chamber (16) via at least one inlet passage (26) in the agitator shaft (18), and which opens via a junction (38) into the inner chamber (28) of the cage-type section (27); and passages (31) formed in the cage-type section (27) and connecting the inner chamber (28) with the grinding-stock inlet chamber (32).

2. An agitator mill according to claim 1, wherein the auxiliary-grinding-body retaining device (35) is a filter cylinder (36) projecting into the inner chamber (28).

3. An agitator mill according to claim 1, wherein between the junction (38) of the return chamber (25) passing into the inner chamber (28) and the auxiliary-grinding-body retaining device (35), a deflector (39) is attached to the cage-type section (27).

4. An agitator mill according to claim 3, wherein the deflector is a deflector disk (39).

5. An agitator mill according to claim 3, wherein the deflector overlaps the auxiliary-grinding-body retaining device (35).

6. An agitator mill according to claim 1, wherein the cage-type section (27) extends as far as into the close vicinity of one of the first and the second end wall of the grinding receptacle (12).

7. An agitator mill according to claim 1, wherein the agitator shaft (18) is provided with a device (46) for cleaning the return chamber (25).

8. An agitator mill according to claim 7, wherein the device (46) comprises a pipe coupling (48) disposed outside of the grinding receptacle (12).

9. An agitator mill according to claim 7, wherein the device (46) comprises a closing piston (53), which is disposed in the return chamber (25) and which is displaceable between a first end position in which the at least one inlet passage (26) is released, and a second end position in which the inlet passage (26) is closed.

10. An agitator mill according to claim 9, wherein the closing piston (53) is attached to a first end of a sliding sleeve (47), to a second end of which the pipe coupling (48) is fastened.

11. An agitator mill, comprising a grinding receptacle (12), of which a cylindrical wall (13) and a first end wall (14) and a second end wall (15) define a grinding chamber (16);

an agitator unit disposed in the grinding receptacle (12) and having an agitator shaft (18), which is cantilevered outside the grinding chamber (16) and finished by a free end inside the grinding chamber (16), and agitator elements (20) attached to the agitator shaft (18);

a drive motor (5) for a high-speed actuation of the agitator unit;

a cage-type section (27), which is attached to the free end of the agitator shaft (18) in vicinity to the second end wall (15) and defines an inner chamber (28);

means for compression free and uniform distribution of auxiliary grinding bodies, said means comprising;

an annular cylindrical grinding-stock inlet chamber (32) between the cage-type section (27) defining an inner chamber (28), and the wall (13) of the grinding receptacle (12);

a grinding-stock inlet (24) disposed at least in vicinity to the second end wall (15) of the grinding receptacle (12) and opening into the annular cylindrical grinding-stock inlet chamber (32);

a grinding-stock/auxiliary-grinding-body return chamber (25), which is formed in the agitator shaft (18), and which, in vicinity to the first end wall (14) of the grinding receptacle (12), is connected with the grinding chamber (16) via at least one inlet passage (26) in the agitator shaft (18), and which opens via a junction (38) into the inner chamber (28) of the cage-type section (27); and passages (31) formed in the cage-type section (27) and connecting the inner chamber (28) with the grinding-stock inlet chamber (32);

said agitator mill further comprising;

an auxiliary-grinding-body retaining device (35) disposed in the inner chamber (28) of the cage-type section (27);

a grinding-stock outlet (37) contiguous to the auxiliary-grinding-body retaining device (35) and passing through the second end wall (15).

* * * * *